US008729832B2

(12) United States Patent
Maxik et al.

(10) Patent No.: US 8,729,832 B2
(45) Date of Patent: May 20, 2014

(54) PROGRAMMABLE LUMINAIRE SYSTEM

(71) Applicant: Lighting Science Group Corporation, Satellite Beach, FL (US)

(72) Inventors: Fredric S. Maxik, Indialantic, FL (US); Robert R. Soler, Cocoa Beach, FL (US); David E. Bartine, Cocoa, FL (US); Mark Andrew Oostdyk, Cape Canaveral, FL (US); Matthew Regan, Melbourne, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 0 days.

(21) Appl. No.: 13/751,180

(22) Filed: Jan. 28, 2013

(65) Prior Publication Data

US 2013/0271036 A1 Oct. 17, 2013

Related U.S. Application Data

(63) Continuation-in-part of application No. 13/107,928, filed on May 15, 2011, now Pat. No. 8,547,391, and a continuation-in-part of application No. 13/403,531, filed on Feb. 23, 2012.

(60) Provisional application No. 61/486,316, filed on May 15, 2011, provisional application No. 61/486,314, filed on May 15, 2011, provisional application No. 61/486,322, filed on May 15, 2011, provisional application No. 61/643,299, filed on May 6, 2012, provisional application No. 61/643,316, filed on May 6, 2012.

(51) Int. Cl.
*H05B 37/02* (2006.01)

(52) U.S. Cl.
USPC ..... 315/307; 315/291

(58) Field of Classification Search
None
See application file for complete search history.

(56) References Cited

U.S. PATENT DOCUMENTS 4,691,341 A 9/1987 Knoble
5,189,412 A 2/1993 Mehta (Continued)

FOREIGN PATENT DOCUMENTS

CN 101 702 421 A 5/2010
WO WO 2009121539 A1 10/2009

(Continued)

OTHER PUBLICATIONS

4Sevens.com, Futlight Color Temperature Adjustable Light Panel, 600x600, www.4sevens.com/product_info.php?products_id=2673, (2012).

(Continued)

*Primary Examiner* — Crystal L Hammond
(74) *Attorney, Agent, or Firm* — Mark R. Malek; Daniel C. Pierron; Zies Widerman & Malek

(57) ABSTRACT

A system comprising a luminaire, a computerized device, and a docking member establishing electrical communication between the luminaire and the computerized device is disclosed. The luminaire may include an optic, a light source, a controller operably coupled to the light source, and an electrical connector configured to couple with the dock. The light source may be operable to emit light having a variety of characteristics, such as luminous intensity, color, color temperature, and any other characteristics of light. The controller may be programmable by a signal received from the computerized device via the dock.

23 Claims, 9 Drawing Sheets

(56) References Cited

U.S. PATENT DOCUMENTS 5,319,301 A 6/1994 Callahan et al.
5,345,143 A 9/1994 Little
5,523,878 A 6/1996 Wallace et al.
5,563,422 A 10/1996 Nakamura et al.
5,680,230 A 10/1997 Kaburagi et al.
5,704,701 A 1/1998 Kavanagh et al.
5,936,599 A 8/1999 Reymond
5,997,150 A 12/1999 Anderson
6,028,396 A 2/2000 Morrissey, Jr.
6,140,646 A 10/2000 Busta et al.
6,341,876 B1 1/2002 Moss et al.
6,356,700 B1 3/2002 Strobl
6,528,954 B1 3/2003 Lys et al.
6,561,656 B1 5/2003 Kojima et al.
6,594,090 B2 7/2003 Kruschwitz et al.
6,733,135 B2 5/2004 Dho
6,767,111 B1 7/2004 Lai
6,798,154 B1 9/2004 Sullivan et al.
6,817,735 B2 11/2004 Shimizu et al.
6,838,836 B2 * 1/2005 Seo et al. ..... 315/169.3
6,853,150 B2 2/2005 Clauberg et al.
6,870,523 B1 3/2005 Ben-David et al.
6,871,982 B2 3/2005 Holman et al.
6,876,007 B2 4/2005 Yamazaki et al.
6,949,894 B1 9/2005 Sullivan et al.
6,965,205 B2 11/2005 Piepgras
6,967,761 B2 11/2005 Starkweather et al.
6,974,713 B2 12/2005 Patel et al.
7,014,336 B1 3/2006 Ducharme et al.
7,042,623 B1 5/2006 Huibers et al.
7,055,994 B2 6/2006 Martin
7,066,628 B2 6/2006 Allen
7,070,281 B2 7/2006 Kato
7,072,096 B2 7/2006 Holman et al.
7,075,707 B1 7/2006 Rapaport et al.
7,083,304 B2 8/2006 Rhoads
7,138,770 B2 11/2006 Uang et al.
7,161,313 B2 1/2007 Piepgras
7,178,941 B2 2/2007 Roberge et al.
7,184,201 B2 2/2007 Duncan
7,246,923 B2 7/2007 Conner
7,255,469 B2 8/2007 Wheatley et al.
7,261,453 B2 8/2007 Morejon et al.
7,289,090 B2 10/2007 Morgan
7,300,177 B2 11/2007 Conner
7,303,291 B2 12/2007 Ikeda et al.
7,325,956 B2 2/2008 Morejon et al.
7,342,658 B2 3/2008 Kowarz et al.
7,344,279 B2 3/2008 Mueller et al.
7,349,095 B2 3/2008 Kurosaki
7,400,439 B2 7/2008 Holman
7,427,146 B2 9/2008 Conner
7,429,983 B2 9/2008 Islam
7,434,946 B2 10/2008 Huibers
7,436,996 B2 10/2008 Ben-Chorin
7,438,443 B2 10/2008 Tatsuno et al.
7,455,435 B2 11/2008 Matthews
7,476,016 B2 1/2009 Kurihara
7,489,086 B2 2/2009 Miskin et al.
7,520,642 B2 4/2009 Holman et al.
7,530,708 B2 5/2009 Park
7,537,347 B2 5/2009 Dewald
7,540,616 B2 6/2009 Conner
7,556,406 B2 7/2009 Petroski et al.
7,567,040 B2 7/2009 Pong et al.
7,598,682 B2 10/2009 Grajcar
7,598,686 B2 10/2009 Lys et al.
7,598,961 B2 10/2009 Higgins
7,605,971 B2 10/2009 Ishii et al.
7,626,755 B2 12/2009 Furuya et al.
7,677,736 B2 3/2010 Kasazumi et al.
7,684,007 B2 3/2010 Hull et al.
7,703,943 B2 4/2010 Li et al.
7,705,810 B2 4/2010 Choi et al.
7,708,452 B2 5/2010 Maxik et al.
7,709,811 B2 5/2010 Conner
7,719,766 B2 5/2010 Grasser et al.
7,728,846 B2 6/2010 Higgins et al.
7,732,825 B2 6/2010 Kim et al.
7,766,490 B2 8/2010 Harbers et al.
7,819,556 B2 10/2010 Heffington et al.
7,828,453 B2 11/2010 Tran et al.
7,828,465 B2 11/2010 Roberge et al.
7,832,878 B2 11/2010 Brukilacchio et al.
7,834,867 B2 11/2010 Sprague et al.
7,835,056 B2 11/2010 Doucet et al.
7,841,714 B2 11/2010 Gruber
7,845,823 B2 12/2010 Mueller et al.
7,852,017 B1 12/2010 Melanson
7,871,839 B2 1/2011 Lee et al.
7,880,400 B2 2/2011 Zhou et al.
7,889,430 B2 2/2011 El-Ghoroury et al.
7,906,789 B2 3/2011 Jung et al.
7,972,030 B2 7/2011 Li
7,976,205 B2 7/2011 Grotsch et al.
8,013,545 B2 9/2011 Jonsson
8,016,443 B2 9/2011 Falicoff et al.
8,040,070 B2 10/2011 Myers et al.
8,047,660 B2 11/2011 Penn et al.
8,049,763 B2 11/2011 Kwak et al.
8,061,857 B2 11/2011 Liu et al.
8,070,302 B2 12/2011 Hatanaka et al.
8,076,680 B2 12/2011 Lee et al.
8,083,364 B2 12/2011 Allen
8,096,668 B2 1/2012 Abu-Ageel
8,115,419 B2 2/2012 Given
8,188,687 B2 5/2012 Lee
8,212,836 B2 7/2012 Matsumoto et al.
8,253,338 B2 * 8/2012 Ashoff et al. ..... 315/133
8,274,089 B2 9/2012 Lee
8,297,783 B2 10/2012 Kim
8,310,171 B2 11/2012 Reisenauer
8,319,445 B2 11/2012 McKinney
8,324,823 B2 12/2012 Choi et al.
8,324,840 B2 12/2012 Shteynberg
8,331,099 B2 12/2012 Geissler et al.
8,337,029 B2 12/2012 Li
8,410,717 B2 4/2013 Shteynberg
8,410,725 B2 4/2013 Jacobs
2004/0052076 A1 3/2004 Mueller et al.
2005/0134188 A1 * 6/2005 Lindqvist ..... 315/149
2006/0002108 A1 1/2006 Ouderkirk et al.
2006/0002110 A1 1/2006 Dowling et al.
2006/0085301 A1 4/2006 Leahy
2006/0164005 A1 7/2006 Sun
2006/0232992 A1 10/2006 Bertram et al.
2006/0285193 A1 12/2006 Kimura et al.
2007/0013871 A1 1/2007 Marshall et al.
2007/0159492 A1 7/2007 Lo et al.
2007/0188847 A1 8/2007 McDonald et al.
2007/0241340 A1 10/2007 Pan
2008/0143973 A1 6/2008 Wu
2008/0180028 A1 * 7/2008 Collins et al. ..... 315/111.21
2008/0198572 A1 8/2008 Medendorp
2008/0232084 A1 9/2008 Kon
2008/0258643 A1 10/2008 Cheng et al.
2009/0009102 A1 1/2009 Kahlman et al.
2009/0059099 A1 3/2009 Linkov et al.
2009/0059585 A1 3/2009 Chen et al.
2009/0128781 A1 5/2009 Li
2009/0160370 A1 6/2009 Tai et al.
2009/0231088 A1 9/2009 Famik
2010/0006762 A1 1/2010 Yoshida et al.
2010/0051976 A1 3/2010 Rooymans
2010/0103389 A1 4/2010 McVea et al.
2010/0141153 A1 * 6/2010 Recker et al. ..... 315/149
2010/0202129 A1 8/2010 Abu-Ageel
2010/0213859 A1 8/2010 Shteynberg et al.
2010/0231863 A1 9/2010 Hikmet et al.
2010/0244700 A1 9/2010 Chong et al.
2010/0270942 A1 10/2010 Hui et al.
2010/0277084 A1 11/2010 Lee et al.
2010/0295483 A1 * 11/2010 Ashoff et al. ..... 315/312
2010/0302464 A1 12/2010 Raring et al.

(56) References Cited

U.S. PATENT DOCUMENTS

| | | | | |
|---|---|---|---|---|
| 2010/0315320 | A1 | 12/2010 | Yoshida | |
| 2010/0320927 | A1 | 12/2010 | Gray et al. | |
| 2010/0320928 | A1 | 12/2010 | Kaihotsu et al. | |
| 2010/0321641 | A1 | 12/2010 | Van Der Lubbe | |
| 2011/0012137 | A1 | 1/2011 | Lin et al. | |
| 2011/0057786 | A1 | 3/2011 | Giddens | |
| 2011/0062888 | A1 | 3/2011 | Bondy | |
| 2011/0089864 | A1* | 4/2011 | Wasniewski et al. | 315/295 |
| 2011/0089866 | A1* | 4/2011 | Trotter et al. | 315/297 |
| 2011/0193484 | A1* | 8/2011 | Harbers et al. | 315/129 |
| 2011/0310446 | A1 | 12/2011 | Komatsu | |
| 2012/0223646 | A1* | 9/2012 | Recker et al. | 315/152 |
| 2012/0286673 | A1 | 11/2012 | Holland et al. | |
| 2012/0286700 | A1 | 11/2012 | Maxik et al. | |
| 2013/0214687 | A1* | 8/2013 | Weaver | 315/151 |

FOREIGN PATENT DOCUMENTS

| | | |
|---|---|---|
| WO | WO 2010027459 | 3/2010 |
| WO | WO 2010098811 | 9/2010 |
| WO | WO 2011008251 | 1/2011 |
| WO | WO 2011016860 | 2/2011 |
| WO | WO 2012/158665 | 11/2012 |

OTHER PUBLICATIONS

Shenzhen Wei Zing Xin Electronic Technology Co., ltd., Hot Color Temperature Adjustable Led Bulb Light, Alibaba.com, www.alibaba.com/product-gs/616428577/Hot_color_tempature_adjustable_led_bulb.html, (Oct. 4, 2012).

Tannith Cattermole, "Smart Energy Glass controls light on demand", Gizmag.com, Apr. 18, 2010, accessed Nov. 1, 2011.

* cited by examiner

PROGRAMMABLE LUMINAIRE SYSTEM

RELATED APPLICATIONS

This application is a continuation-in-part and claims the benefit under 35 U.S.C. §1.53(b) of U.S. patent application Ser. No. 13/107,928 titled High Efficacy Lighting Signal Converter and Associated Methods filed May 15, 2011 and U.S. patent application Ser. No. 13/403,531 titled Configurable Environmental Condition Sensing Luminaire, System and Associated Methods filed on Feb. 23, 2012, which, in turn, claims the benefit of U.S. Provisional Patent Application Ser. No. 61/486,316 titled Motion Detecting Security Light and Associated Methods filed on May 15, 2011, U.S. Provisional Patent Application Ser. No. 61/486,314 titled Wireless Lighting Device and Associated Methods filed on May 15, 2011, and U.S. Provisional Patent Application Ser. No. 61/486,322 titled Variable Load Power Supply filed on May 15, 2011, the entire contents of each of which are incorporated herein by reference in their entireties. Additionally, this application claims benefit under 35 U.S.C. §119(e) of U.S. Provisional Patent Application Ser. No. 61/643,299 titled Tunable Lighting Apparatus filed on May 6, 2012 and U.S. Provisional Patent Application Ser. No. 61/643,316 titled Luminaire Having an Adaptable Light Source and Associated Methods filed on May 6, 2012, the entire contents of each of which are incorporated herein by reference in their entireties.

FIELD OF THE INVENTION

The present invention relates to systems and methods for programming a luminaire to emit light having desirable lighting characteristics.

BACKGROUND OF THE INVENTION

As luminaires have increasingly relied on electronic components in their operation, those electronic components frequently require use of a microcontroller to govern operation thereof. Accordingly, the microcontroller must be provided with instructions to operate the luminaire, the instructions commonly being referred to as programming. Moreover, as luminaires have expanded in capability to be able to generate light with varying characteristics, the electronic components associated with such capability have increased in complexity in order to enable such varying characteristics.

However, as the capabilities of luminaires have increased, the electronic components enabling such capabilities have focused on the ability of a user to continuously vary the lighting characteristics of the luminaire. For example, U.S. Pat. No. 8,013,545, entitled *Modular Networked Light Bulb*, discloses a light bulb having a networking module that enables the light bulb to operate with varying levels of luminous intensity according to information received by the networking module from across the network. Additionally, U.S. Pat. No. 6,528,954, entitled *Smart Light Bulb*, discloses a light bulb that is configured to transmit and/or receive a signal from another device across a network and operate responsive to that signal/control the operation of another light bulb responsive to that signal. This additional functionality of luminaires requires additional electronic components, increasing the cost of a luminaire that may have the ability to produce light with selective color characteristics. Frequently, the cost of the additional functionality of the luminaires causes a marginal number of consumers to decide against purchasing such a light bulb. Therefore, there is a need for a light bulb with the capability to emit light with variable characteristics while reducing cost by exclusion of undesired or unnecessary features, such as networked operation.

Additionally, in the current market, consumers seeking to purchase luminaires with fixed luminous intensity, color temperature, or other characteristics of light must currently select a luminaire from a vast array of the varying permutations of luminous intensity, color temperature, etc. Frequently, the cost of the luminaire can be a determining factor in the purchasing decision of the consumer. Moreover, a store seeking to accommodate such customers must maintain stock of the variety of luminaires, and have sufficient shelf space to display the luminaires. Accordingly, there is a need for a low-cost luminaire that provides light with fixed light characteristics at a favorable cost while simultaneously reducing the necessary inventory and shelf-space used by a merchant in offering a sufficient variety of combinations of light characteristics for sale.

This background information is provided to reveal information believed by the applicant to be of possible relevance to the present invention. No admission is intended, nor should be construed, that any of the preceding information constitutes prior art against the present invention.

SUMMARY OF THE INVENTION

With the foregoing in mind, embodiments of the present invention are related to a system for programming a luminaire to emit light having certain selected characteristics while reducing the cost of the luminaire. The system may be comprised of a luminaire, a computerized device, and a docking member establishing electrical communication between the luminaire and the computerized device.

The luminaire may include an optic, a light source, a controller operably coupled to the light source, and an electrical connector configured to couple with the dock. The light source may be operable to emit light having a variety of characteristics, such as luminous intensity, color, color temperature, and any other characteristics of light. The luminaire may be configured to be placed in electric communication with the computerized device by coupling the electrical connector with the dock. The controller may be programmable by a signal received from the computerized device via the dock. Moreover, the controller may be configured to only be programmable once, and either be prevented from being re-programmed, or have, as a structural limitation, the inability to be re-programmed. Alternatively, the controller may be reprogrammed either with great difficulty or at a very slow rate.

The docking member may be a device configured to engage with the electrical connector so as to electrically couple with the electrical connector. Furthermore, the docking member may be electrically coupled with the computerized device, thereby permitting an electrical connection to be established between the luminaire and the computerized device. The computerized device may be configured to generate a signal that causes the controller to be programmed to operate the light source to produce light having desirable characteristics.

A method aspect of the present invention is for programming a lighting apparatus to emit light within a range of light characteristics. The method may include positioning the electrical connector in electronic communication with a computerized device. The method may also include receiving, by the controller, an electronic transmission containing data via the electrical connector, and programming the controller responsive to the received electronic transmission. Each light-emitting element of the plurality of light-emitting elements is operable to emit a source light, and some of the source lights may combine in the optical chamber to define a combined light. The step of programming the controller may cause the controller to be programmed to selectively operate a subset of the plurality of light-emitting elements to produce a combined light having a light characteristic within the particular temperature range or other discrete characteristic of light.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
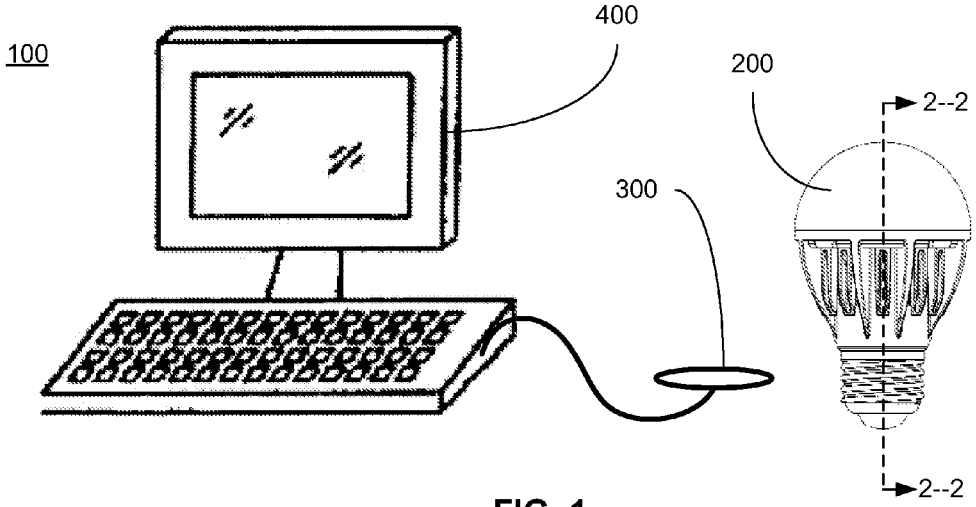
FIG. 1 is a schematic environmental view of a system for programming a programmable luminaire according to an embodiment of the present invention.

An embodiment of the invention, as shown and described by the various figures and accompanying text, provides a system for programming a programmable luminaire. Referring now to FIG. 1, the system 100 may include a luminaire 200, a docking member 300, and a computerized device 300. The docking member 300 may be configured to couple with each of the luminaire 200 and the computerized device 400, thereby establishing electrical communication with each of the luminaire 200 and the computerized device 400. This, in turn, facilitates electrical communication between the luminaire 200 and the computerized device 400.

Figure 2:
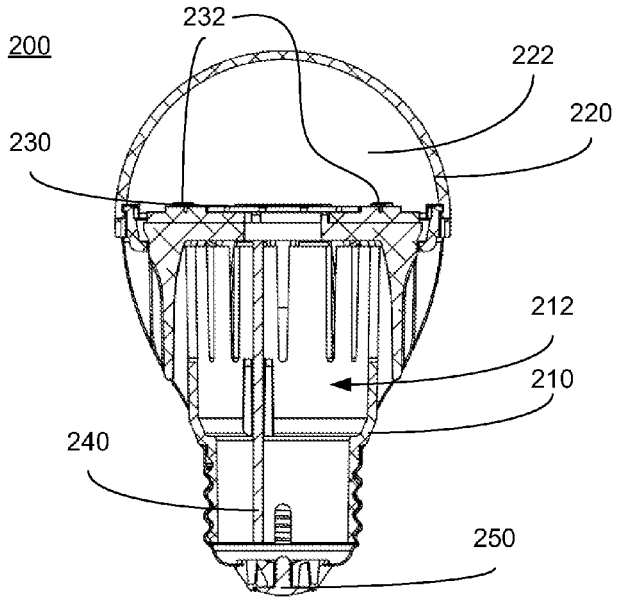
FIG. 2 is a sectional view of the programmable luminaire depicted in FIG. 1 taken through line 2-2.

Referring now to FIG. 2, the luminaire 200 of the present embodiment will now be discussed in greater detail. The luminaire 200 may include a body member 210, an optic 220, a light source 230, a controller 240, and an electrical connector 250. The body member 210 may be configured to define an internal cavity 212 within which the controller 240 may be disposed. Additionally, the body member 210 may be configured to attach to and carry the optic 220. Furthermore, the body member 210 may be configured to attach to and carry the light source 230.

The optic 220 be configured to attach to an upper edge of the body member 210, and may be configured to define an optical chamber 222. The optic 220 and the optical chamber 222 may be configured so as to facilitate the combination of source light emitted into the optical chamber 222 to propagate through the optic 220 as a combined light having one or more selected and discrete characteristics of light. The emission of source light and the resulting combined light will be discussed in greater detail hereinbelow.

Continuing to refer to FIG. 2, the light source 230 will now be discussed in greater detail. The light source 230 may be any device capable of or method of emitting light. Such devices include, without limitation, incandescent light bulbs, fluorescent lights, light-emitting semiconductors, arc lamps, and any other devices known in the art. In the present embodiment, the light source 230 may include a plurality of light-emitting elements 232 being light-emitting semiconductors, more specifically, light-emitting diodes (LEDs). More details regarding an example of the general structure of a luminaire may be found in U.S. Provisional Patent Application Ser. No. 61/642,257 titled Luminaire Having a Vented Enclosure filed May 3, 2012, the entire contents of which are incorporated by reference herein. The luminaire described therein is exemplary only and does not limit the scope of the structure of the luminaire 200 or the scope of the invention generally.

Additionally, as in the present embodiment, where the light-emitting elements 232 are LEDs, the light source 230 may include an LED board 234. The LED board 234 may include necessary circuitry so as to enable the operation of the plurality of LEDs 232. Furthermore, the LED board 234 may include the necessary circuitry so as to enable the individual operation of each of the plurality of LEDs 232. Other embodiments of the light source 230 may include light-emitting elements 232 other than LEDs, but may include a structure similar to the LED board 234 that enables the operation of light-emitting elements 232.

The light source 230 may be configured to emit light having a selected characteristic. For example, and not by limitation, the light source 230 may be configured to emit light having a selected color, color temperature, chromaticity, or luminous intensity. In some embodiments, the light source 230 may be configured to emit light having a color temperature selected within the range from about 2,000 Kelvin to about 25,000 Kelvin. In some embodiments, the light source 230 may be configured to emit light having a luminous intensity selected within the range from about 100 lumens to about 2,600 lumens. These ranges are exemplary only and do not limit the scope of the invention. Moreover, the light source 230 may be configured to emit all color temperatures and luminosities described hereinabove, and may be operated so as to emit a selected color temperature, luminous intensity, or both, or any other combination of selected characteristics of light as described in greater detail hereinbelow.

Where, as in the present embodiment, the light source 230 comprises a plurality of LEDs 232, the light source 230 may include LEDs 232 that each emit a source light, as described hereinabove. Each source light may have an associated dominant wavelength and luminous intensity. The LEDs 232 may be positioned such that the source lights emitted by the LEDs 232 propagates into the optical chamber 222. As the source lights propagate into and through the optical chamber 222, they may combine to form a combined light, as described hereinabove. Once the combined light is formed, it may then propagate through the optic 220 and into the environment surrounding the luminaire 200.

The source lights emitted by the LEDs 232 may be varied, such that a source light emitted by one LED 232 may have a different dominant wavelength, luminous intensity, or other characteristic of light than a source light emitted by another LED 232. Accordingly, when the source lights combine in the optical chamber 220 forming the combined light, the combined light may be a polychromatic light, comprising two or more wavelengths. Accordingly the combined light may have a color that is determined according to the polychromaticity of the combined light. Moreover, the luminous intensity of each of the source lights may also affect the luminous intensity, as well as the chromaticity, of the combined light. More information regarding the combination of light emitted by a plurality of LEDs 232 to form a combined light may be found in patent application Ser. No. 13/107,928 titled High Efficacy Lighting Signal Converter and Associated Methods as well as in U.S. Provisional Patent Application Ser. No. 61/643,299 titled Tunable Lighting Apparatus, both of which were incorporated by reference hereinabove.

Moreover, the LEDs 232 included in the light source 230 may be selected so as to combine to form a color gamut that includes a range of the characteristic of light to be controller. For example, the LEDs 232 may define a color gamut that includes the color temperature range from about 2,000 Kelvin to about 25,000 Kelvin. In a further example, the light source 230 may include a red LED, a green LED, and a blue LED. Additionally, the light source 230 may include a high-efficacy LED, such as, for example, a mint-white LED. The LEDs 232 included in the light source may be selected so as to have the greatest luminosity as defined by the photopic luminosity function $$F=683.002\ \mathrm{lm}/W\int_0^{\infty}\nabla(\lambda)J(\lambda)d\lambda$$

where F is the luminous flux, J(λ) is the spectral power distribution of the combined light, $y_{bar}$ is the standard luminosity function, and λ is wavelength. For example, the red LED may have a dominant wavelength of about 590 nanometers, the green LED may have a dominant wavelength of about 555 nanometers, and the blue LED may have a dominant wavelength of about 470 nanometers.

Still referring to FIG. 2, the controller 240 will now be discussed in greater detail. The controller 240 may be an electronic device that is capable of operating the light source 230 so as to emit light having a desired characteristic. More specifically, as in the present embodiment, where the light source 230 includes a plurality of light-emitting elements 232, the controller 240 may be operably connected to the plurality of light-emitting elements 232 to selectively operate each of the LEDs 232 of the plurality of LEDs 232 to produce a combined light having a selected characteristic. The selected characteristic may be those described hereinabove, including, but not limited to, color, color temperature, chromaticity, and luminous intensity.

The controller 240 may control the light source 230 to emit light having a selected color temperature by selectively operating a subset of the plurality of LEDs 232 that combine to form a combined light having the selected color temperature as described hereinabove and in the referenced applications. Additionally, the controller 240 may control the light source 230 to emit light having a selected luminous intensity. The controller 240 may control the luminous intensity of the LEDs 232 by any method known in the art, such as, for example, pulse-width modulation (PWM). More information regarding implementation of PWM may be found in U.S. patent application Ser. No. 13/073,805 titled MEMS Wavelength Converting Lighting Device and Associated Methods filed Mar. 28, 2011, which is incorporated herein in its entirety by reference.

The controller 240 may be an electronic device that is capable of being programmed. More specifically, the controller 240 may be an electronic device that may receive an instruction by an electrical signal and be programmed according to the information contained within that signal. In the present embodiment, the controller 240 may be an electronic device that receives a signal containing instructions related to the selected characteristic of light and is programmed responsive to the signal so as to operate the light source 230 to produce a combined light having the selected characteristic of light.

In some embodiments, the controller 240 may be preprogrammed prior to receiving a signal indicating a desired characteristic of light. For example, where, as in the present embodiment, the light source 230 comprises a plurality of LEDs 232, the controller 240 may include a lookup table for selectively operating differing subsets of the plurality of LEDs 232 to produce a combined light having certain characteristics of light, such as color, color temperature, luminous intensity, and chromaticity, and combinations thereof. When the controller 240 receives an input indicating the selected characteristics of light, the controller 240 may determine which of the plurality of LEDs 232 can be operated to produce a combined light having the selected characteristics.

The controller 240 may be an electronic device that is either configured to be programmed a finite number of times, or it may have as a structural limitation a finite number of times it can be programmed. Such electronic devices are known in the art, including, but not limited to, programmable read-only memory (PROM), field programmable read-only memory (FPROM), and one-time programmable non-volatile memory.

In some embodiments, the controller 240 may be configured to include firmware that is programmed responsive to a signal containing instructions that causes the programming, or re-programming, of the firmware. Accordingly, the controller 240 may be operate the light source 230 responsive to one or more signals that do not include a instructions to be programmed into the firmware, and may program its firmware responsive to a signal including instructions to be programmed into the firmware. This functionality of the controller 240 will be discussed in greater detail hereinbelow.

Continuing to refer to FIG. 2, the electrical connector 250 will now be discussed in greater detail. The electrical connector 250 may be a structure that enables the luminaire 200 to electrically couple with the docking member 300. More specifically, the electrical connector 250 may be configured to enable the luminaire 200 to receive a signal via the docking member 300. The electrical connector 250 may be positioned in electrical communication with the various elements of the luminaire 200, including the controller 240. Accordingly, the controller 240 may receive the signal containing instructions that the controller 240 may be programmed responsive to via the electrical connector 250. Moreover, the electrical connector 250 may receive electrical power that may be used to energize and render operable the various electric elements of the luminaire 200, including the light source 230 and the controller 240. Furthermore, the luminaire 200 may include necessary electrical components to condition electrical power received by the electrical connector 250 so as to be used by the various electrical elements of the luminaire 200, including the light source 230 and the controller 240.

The electrical connector 250 may be configured into a specific form factor. In some embodiments, the electrical connector 250 may be configured into a form factor that conforms with bases for light bulbs, including, but not limited to, Edison screw bases, bayonet bases, bi-post bases, bi-pin bases, and wedge bases. Where the electrical connector 250 is a base for a light bulb, the controller 240 may further include electronic components that enable power line communication (PLC), and the controller 240 may receive the signal described hereinabove via the PLC electronic components. In some embodiments, the luminaire 200 may include two or more electrical connectors 250. In those cases, one of the electrical connectors 250 may be a light bulb base as described above, and the other may be configured into a form factor that conforms with an interface standard, including, but not limited to, Universal Serial Bus (USB), IEEE 1394 (FireWire), Thunderbolt, Ethernet, or any other interface standard that is known in the art. Where the luminaire 200 includes an electrical connector 250 formed into one of these configurations, the controller 240 may include electronic components and circuitry necessary to enable communication through the electrical connector 250.

Figure 3:
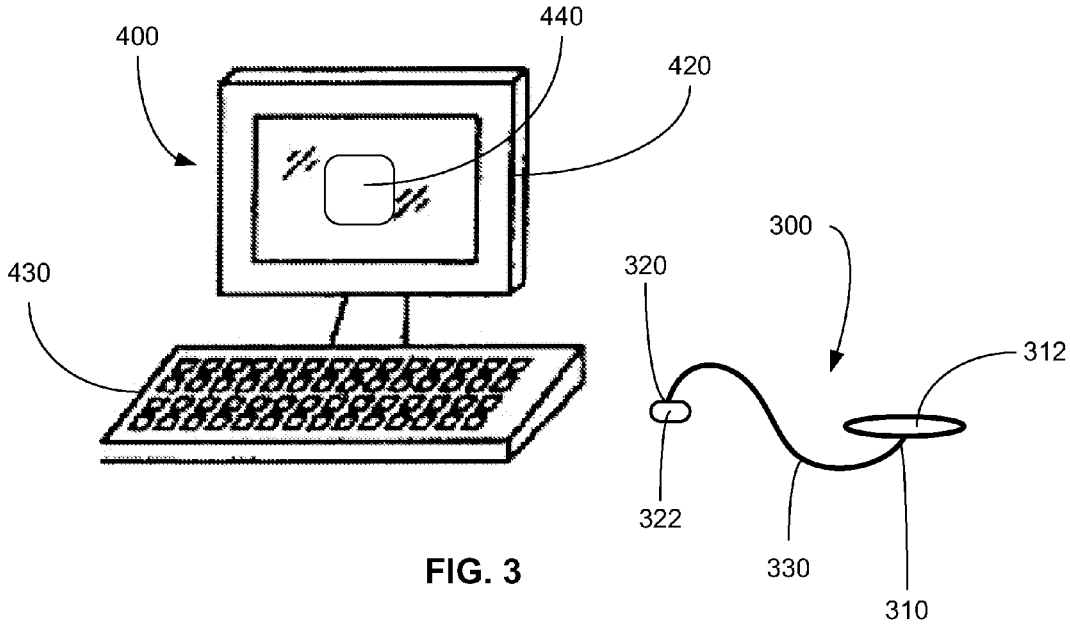
FIG. 3 is a computerized device and docking member of the system depicted in FIG. 1.

Referring now to FIG. 3, the docking member 300 will now be discussed in greater detail. The docking member 300 may be configured to couple with each of the luminaire 200 and the computerized device 400, thereby establishing electrical communication with each of the luminaire 200 and the computerized device 400, thereby facilitating electrical communication between the luminaire 200 and the computerized device 400.

The docking member 300 may have a first end 310 having a luminaire attaching device 312 and a second end 320 having a computerized device attaching device 322. The luminaire attaching device 312 may be configured into a form factor that cooperates with the form factor of the electrical connector 250 of the luminaire 200, enabling the luminaire attaching device to engage with and electrically couple to the electrical connector 250. Accordingly, where the electrical connector 250 is formed into a light bulb base, the luminaire attaching device 312 may be formed into a corresponding socket. Similarly, where the luminaire 200 includes an electrical connector 250 formed into a connector complying with an interface standard, the luminaire attaching device 312 may be formed into a mating interface that is compliant with the same interface standard of the electrical connector 250.

The computerized device attaching device 322 may be formed into a form factor that cooperates with the form factor of a connector on the computerized device 400. For example, the computerized device attaching device 322 may be formed into a form factor complying with an interface standard, such as the interface standards disclosed hereinabove.

The docking member 300 may further include an intermediate section 330 that is configured to connect and establish an electrical connection between the luminaire attaching device 312 and the computerized device attaching device 322. The intermediate section 330 may formed as a cord comprising one or more wires that permit the transmission of electricity therethrough. The intermediate section may enable the transmission of electric signals therethrough as well as the delivery of electrical power.

Referring now to FIG. 3, the computerized device 400 will now be discussed in greater detail. The computerized device 400 may be any electronic device that is capable of generating and transmitting a signal to program the controller 240. Accordingly, the computerized device 400 may include the necessary electronic components for generating a signal containing programming instructions for the controller 240 and transmitting that signal to the luminaire 200 via the docking member 300. The computerized device 400 may include a connector 410 that is configured to engage with and electrically couple to the computerized device attaching device 322 of the docking member 300, thereby permitting signals sent from the computerized device 400 to be transmitted to the luminaire 200 through the docking member 300. In some embodiments, where the computerized device attaching device 322 is configured into an interface standard, the connector 410 may be configures as a port complying with the interface standard embodied in the computerized device attaching device 322.

In one embodiment, the computerized device 400 may include software, hardware, and peripheral hardware that enables a user to provide inputs to the computerized device to which the programming signal sent to the luminaire 200 may be responsive to. For example, the computerized device may include a display 420, a user input device 430, and a user interface 440. The display 420 may be any visual display that can convey textual, pictorial, and video information to the user. The user input device 430 may be any device that enables the user to provide an input to the computerized device 400, such as a keyboard or a mouse. Additionally, the display 420 may be a touch-screen device, thus making the display 420 capable of receiving an input from the user.

The user interface 440 may be software that is configured to provide information to the user, prompt the user for input, and interpret input received from the user. The user interface 440 may prompt the user to input information related to the light to be emitted by the light source 230. For instance, the user interface 440 may prompt the user to select at least one of a color, color temperature, chromaticity, and luminous intensity. When the user interface 440 receives the requested input, the computerized device 400 may generate a signal containing programming instructions that will program the controller 240 to operate the light source 230 to generate the light indicated by the user input.

The user interface 440 may further include options to display an estimation of the light indicated by the user input as it will be generated by the luminaire 200 on the display 420 prior to transmitting the programming signal to the controller 240. The user interface 440 may then prompt the user for input querying whether to program the controller to emit the light indicated by the previous user input, or the user may input a new light indicated by the user's subsequent input. More details regarding the various processes for receiving input from the user will be discussed in greater detail hereinbelow. More details regarding the computerized device 400 may be found in U.S. Provisional Patent Application Ser. No. 61/643,316, which is incorporated by reference hereinabove.

Figure 4:
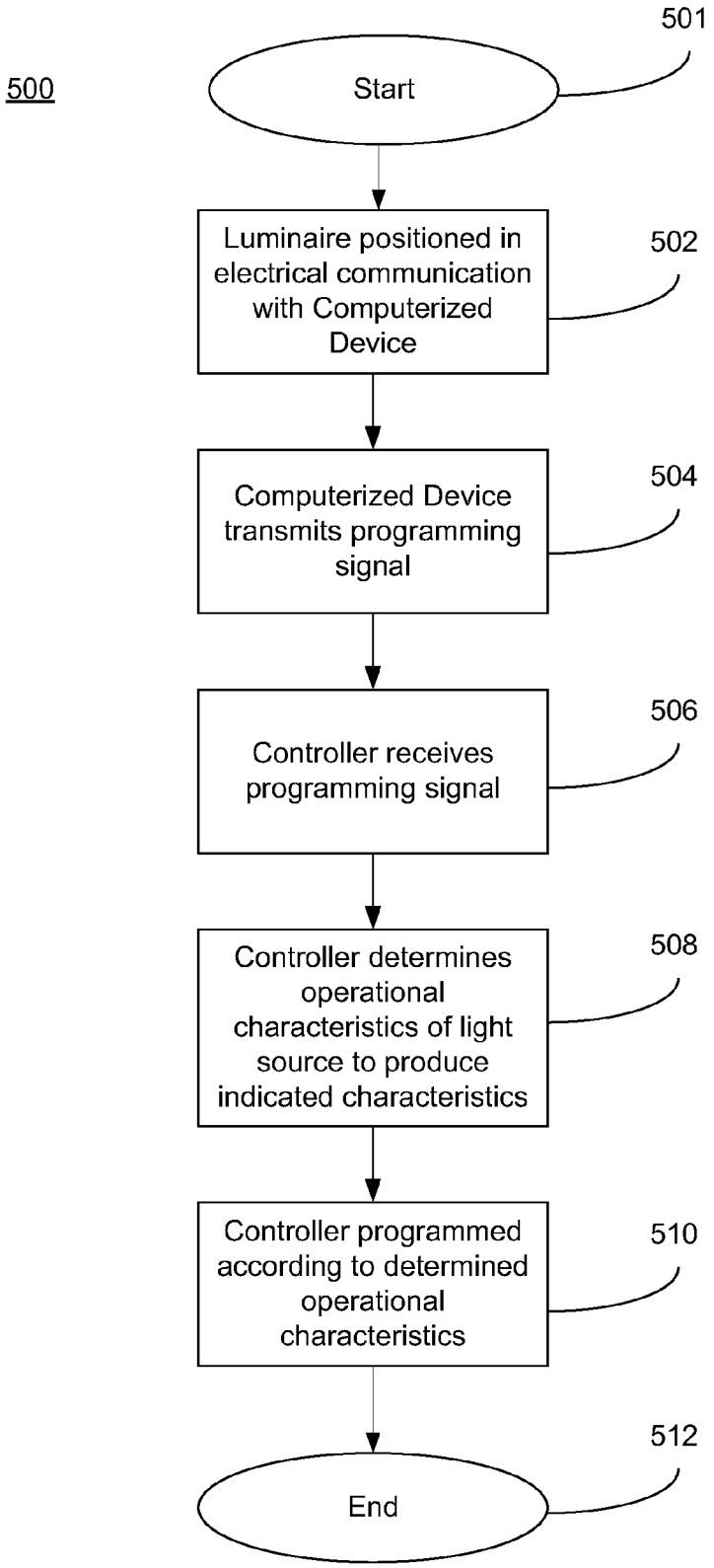
FIGS. 4-10 are flowcharts illustrating various methods of programming a programmable luminaire according to embodiments of the present invention.

Referring now to the flowchart 500 illustrated in FIG. 4, a method aspect of the present invention is now described in greater detail. The method according to the present invention, and as illustrated in flowchart 500 of FIG. 4, is directed to programming a luminaire to emit light having selected characteristics. From the start 501 a luminaire is positioned into electrical communication with the computerized device at Block 502. This step may be accomplished by engaging an element such as the docking member with each of the luminaire and the computerized device, and establishing a electrical communication therebetween. At Block 504, the computerized device may transmit a signal to the luminaire that is configured to program the luminaire to emit light having selected characteristics. In this embodiment, the signal sent to the luminaire provides only an indication of the lighting characteristics to be produced by the luminaire. At Block 506, the luminaire, and by extension the controller, receives the programming signal. At Block 508, the controller determines the operational characteristics of the light source that will produce light having the characteristics indicated in the programming signal. At Block 510, the controller is programmed according to the determined operational characteristics of the light source to produce light having the characteristics indicated in the programming signal. The method is ended at Block 512.

Figure 5:
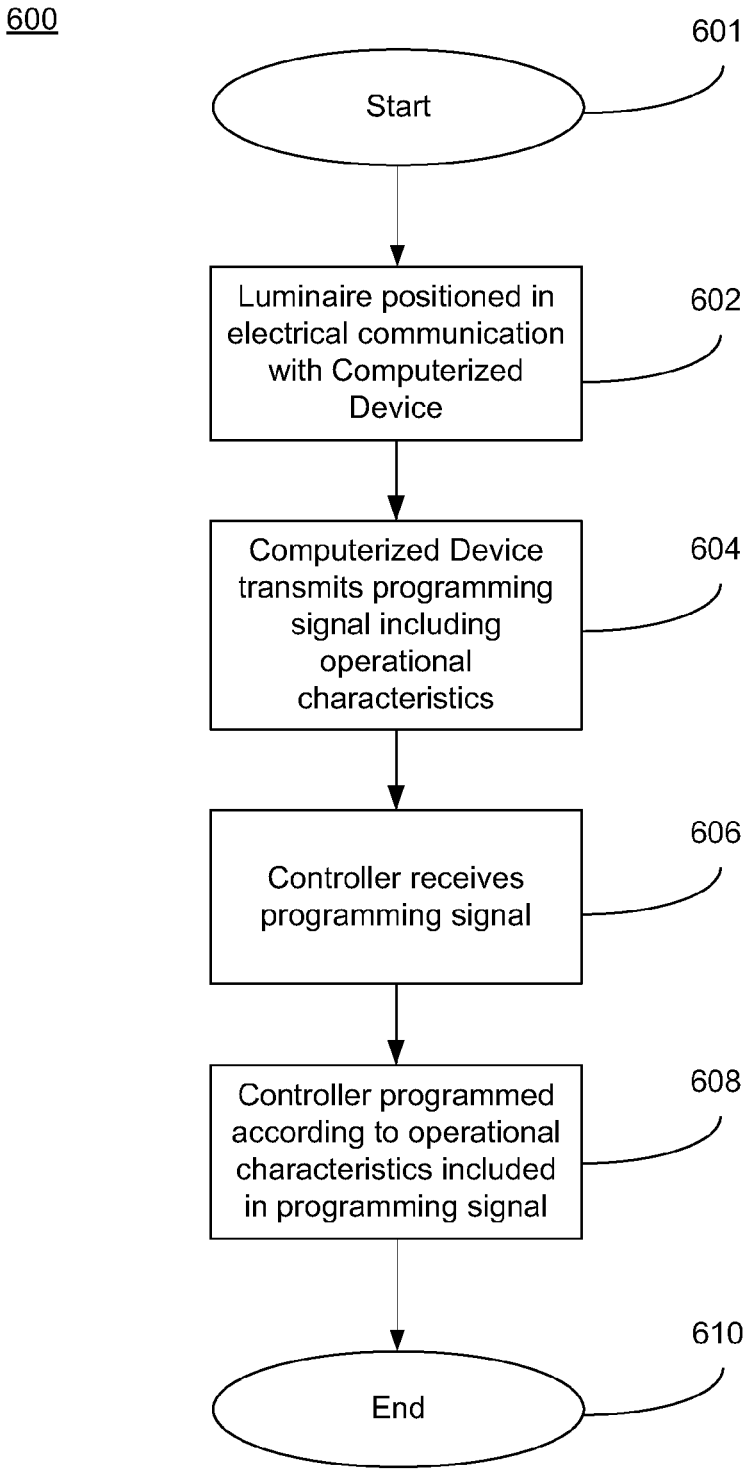

Referring now additionally to flowchart 600 illustrated in FIG. 5, a method aspect of the present invention is now described in greater detail. In this embodiment of the method according to the present invention, the controller does not have the capacity or has not been prep-programmed to include sufficient information to interpret a programming signal that includes only the indication of the characteristics of light to be produced by the luminaire. Instead, the programming signal must contain more specific programming instructions.

From the start (Block 601), the luminaire may be positioned into electrical communication with the computerized device at Block 602. At Block 604, the computerized device may transmit a signal to the luminaire that is configured to program the luminaire to emit light having selected characteristics. As noted above, the programming signal sent from the computerized device in this method contains more information than the selected characteristics of light. Instead, due to the controller lacking the capability of interpreting the selected characteristics of light into operational characteristics of the light source, the programming signal itself must provide the operational instructions for the light source to the controller. In some embodiments, where the light source comprises a plurality of LEDs, the programming signal may include instructions for which of the plurality of LEDs should be operated, and at what luminous intensity. At Block 606, the luminaire, and by extension the controller, receives the programming signal, and at Block 608 the controller is programmed according to the operational characteristics included in the programming signal. The method is ended at Block 610.

Figure 6:
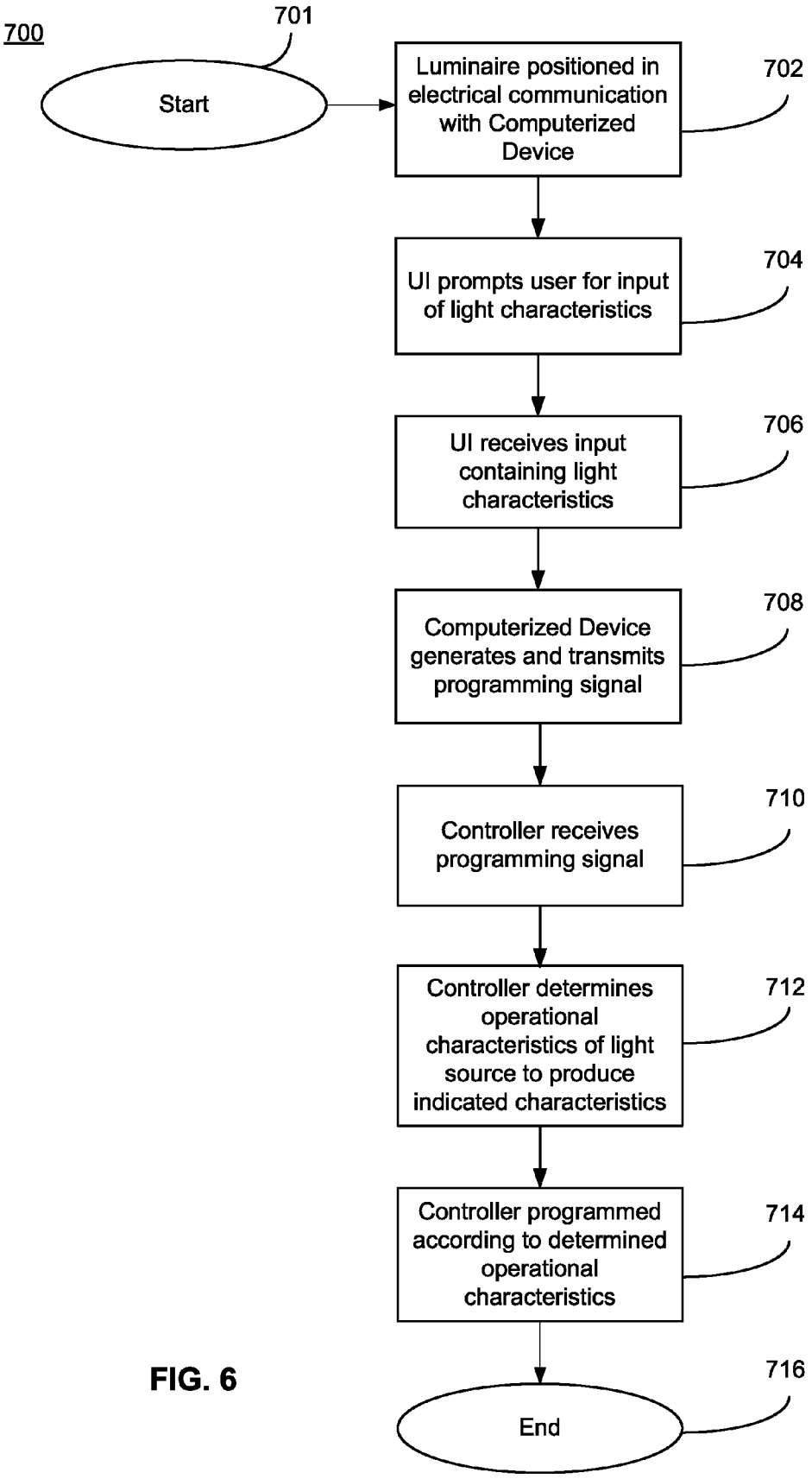

Referring now additionally to flowchart 700 illustrated in FIG. 6, another method aspect of an embodiment of the present invention is now described in greater detail. In the method of this embodiment of the present invention, the computerized device may receive the selected characteristics of light from inputs to a user interface, as described hereinabove. From the start (Block 701), the luminaire may be positioned into electrical communication with the computerized device at Block 702. At Block 704, the user interface prompts a user to input the characteristics of light to be produced by the luminaire. At Block 706, the user interface receives an input from the user providing one or more characteristics of light for the light source to produce. At Block 708, the computerized device generates a signal responsive to the user input that includes the selected characteristics of light and transmits the signal to the luminaire. At Block 710, the luminaire, and by extension the controller, receives the programming signal. At Block 712, the controller determines the operational characteristics of the light source that will produce light having the characteristics indicated in the programming signal. At Block 714, the controller is programmed according to the determined operational characteristics of the light source to produce light having the characteristics indicated in the programming signal. The method is ended at Block 716.

Figure 7:
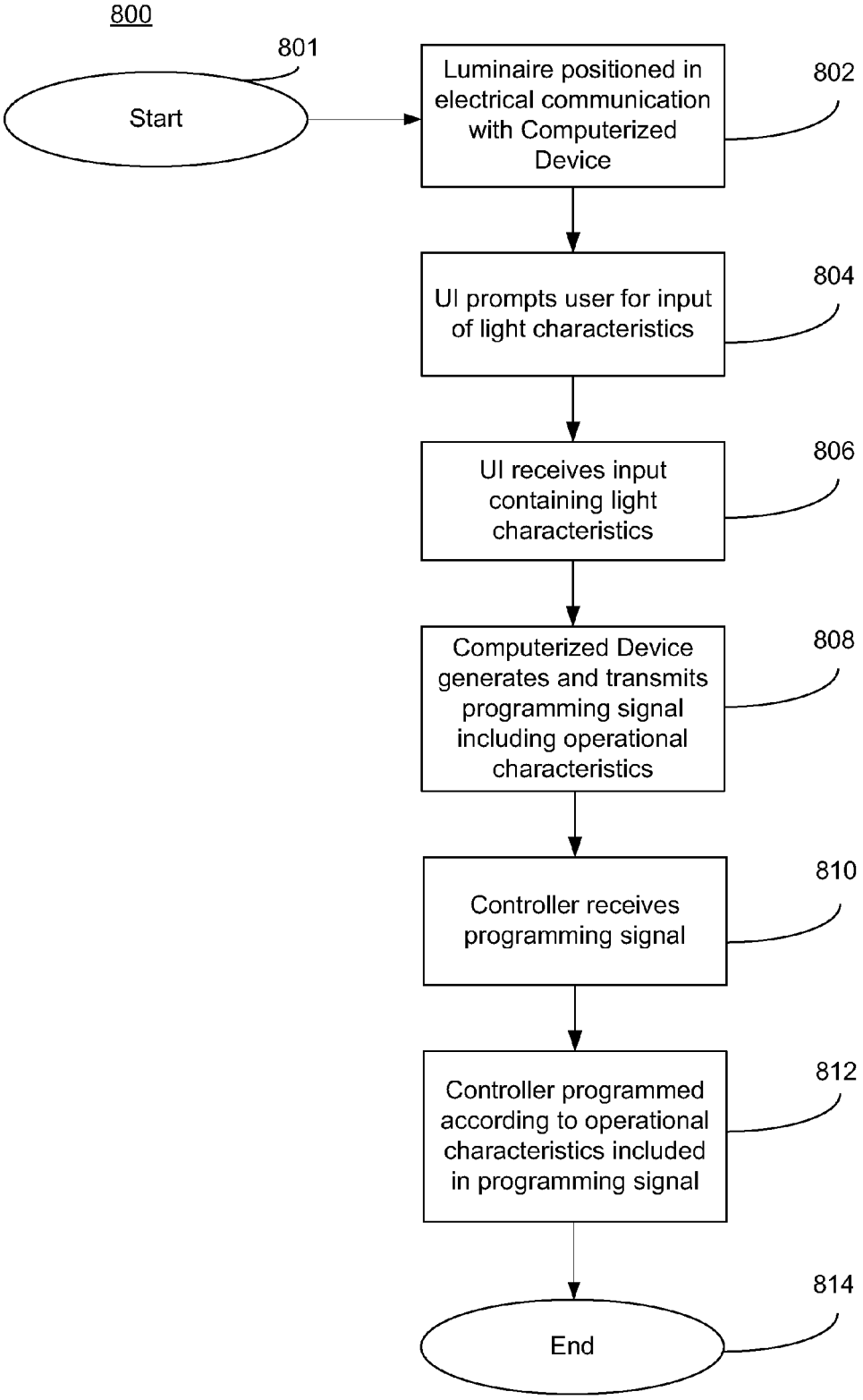

Referring now additionally to flowchart 800 illustrated in FIG. 7, a method aspect of the present invention is now described in greater detail. In the present method, the controller does not have the capacity or has not been prep-programmed to include sufficient information to interpret a programming signal that includes only the indication of the characteristics of light to be produced by the luminaire. Instead, the programming signal must contain more specific programming instructions. Additionally, the computerized device receives the selected characteristics of light from inputs to a user interface, as described hereinabove.

From the start (Block 801), the luminaire may be positioned into electrical communication with the computerized device at Block 802. At Block 804, the user interface prompts a user to input the characteristics of light to be produced by the luminaire. At Block 806, the user interface receives an input from the user providing one or more characteristics of light for the light source to produce. At Block 808, the computerized device generates a signal responsive to the user input that includes the selected characteristics of light and transmits the signal to the luminaire. As noted above, the programming signal sent from the computerized device in this method contains more information than the selected characteristics of light. Instead, due to the controller lacking the capability of interpreting the selected characteristics of light into operational characteristics of the light source, the programming signal itself must provide the operational instructions for the light source to the controller, as described hereinabove. At Block 810, the luminaire, and by extension the controller, receives the programming signal, and at Block 812 the controller is programmed according to the operational characteristics included in the programming signal. The method is ended at Block 814.

Figure 8:
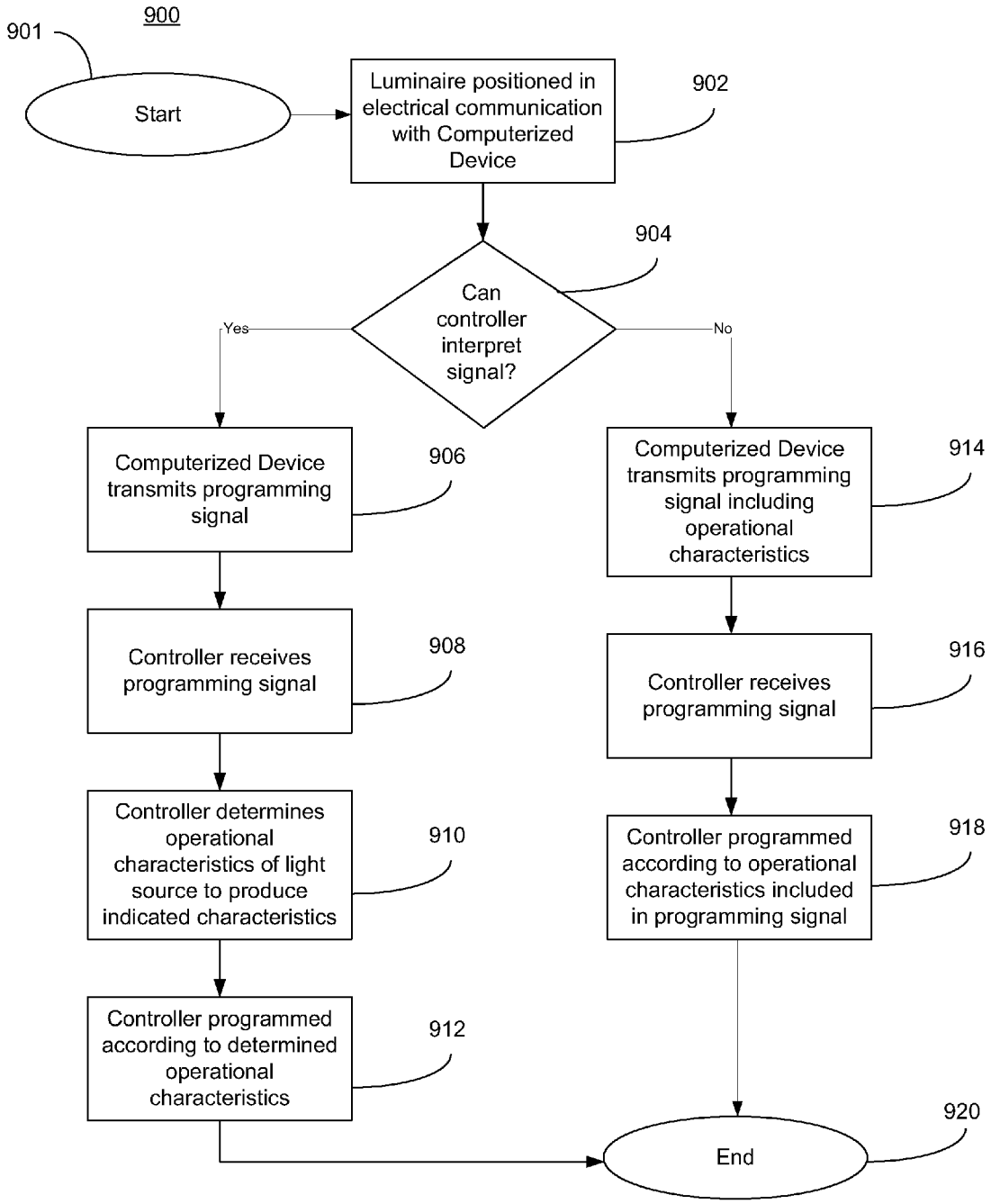

Referring now additionally to flowchart 900 illustrated in FIG. 8, a method aspect of the present invention is now described in greater detail. In the present method, the computerized device may determine whether the controller is capable of interpreting a signal containing only selected characteristics of light. From the start (Block 901), the luminaire is positioned into electrical communication with the computerized device at Block 902. At Block 904, the computerized device determines whether the controller is capable of interpreting a signal containing selected characteristics of light and determining the attending operational characteristics of the light source to produce the selected characteristics. This may be accomplished by any known method, such as, for example, transmitting a signal to the luminaire the results in a response providing such an indication. This is a non-limiting example and all known methods are contemplated and included in the invention.

If, at Block 904, it is determined that the controller can interpret the programming signal, then at Block 906 the computerized device may generate and transmit a programming signal containing only the selected light characteristics. At Block 908, the luminaire, and by extension the controller, receives the programming signal. At Block 910, the controller determines the operational characteristics of the light source that will produce light having the characteristics indicated in the programming signal. At Block 912, the controller is programmed according to the determined operational characteristics of the light source to produce light having the characteristics indicated in the programming signal.

If, at Block 904, it is determined the controller cannot interpret the programming signal, then at Block 914, the computerized device may generate and transmit a signal to the luminaire that includes the operational characteristics necessary to program the luminaire to emit light having the selected characteristics. At Block 916, the luminaire, and by extension the controller, receives the programming signal, and at Block 918 the controller is programmed according to the operational characteristics included in the programming signal. The method is ended at Block 920.

Figure 9:
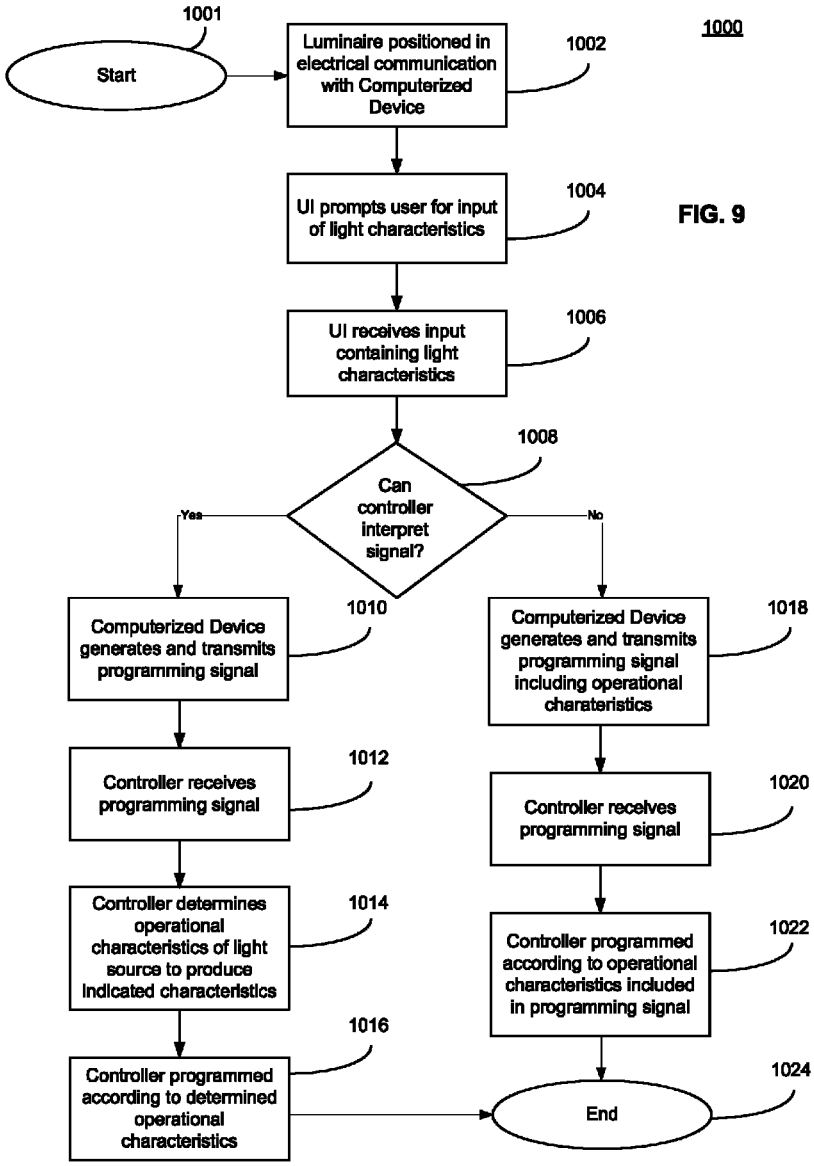

Referring now additionally to flowchart 1000 illustrated in FIG. 9, a method aspect of the present invention is now described in greater detail. In the present method, the computerized device receives the selected characteristics of light from inputs to a user interface, as described hereinabove. Additionally, the computerized device may determine whether the controller is capable of interpreting a signal containing only selected characteristics of light.

From the Start (Block 1001), the luminaire is positioned into electrical communication with the computerized device at Block 1002. At Block 1004, the user interface prompts a user to input the characteristics of light to be produced by the luminaire. At Block 1006, the user interface receives an input from the user providing one or more characteristics of light for the light source to produce. At Block 1008, the computerized device determines whether the controller is capable of interpreting a signal containing selected characteristics of light and determining the attending operational characteristics of the light source to produce the selected characteristics, as described hereinabove.

If, at Block 1008, it is determined that the controller can interpret the programming signal, then at Block 1010 the computerized device may generate and transmit a programming signal containing only the selected light characteristics. At Block 1012, the luminaire, and by extension the controller, receives the programming signal. At Block 1014, the controller determines the operational characteristics of the light source that will produce light having the characteristics indicated in the programming signal. At Block 1016, the controller is programmed according to the determined operational characteristics of the light source to produce light having the characteristics indicated in the programming signal.

If, at Block 1008, it is determined the controller cannot interpret the programming signal, then at Block 1018, the computerized device may generate and transmit a signal to the luminaire that includes the operational characteristics necessary to program the luminaire to emit light having the selected characteristics. At Block 1020, the luminaire, and by extension the controller, receives the programming signal, and at Block 1022 the controller is programmed according to the operational characteristics included in the programming signal. The method is ended at Block 1024.

Figure 10:
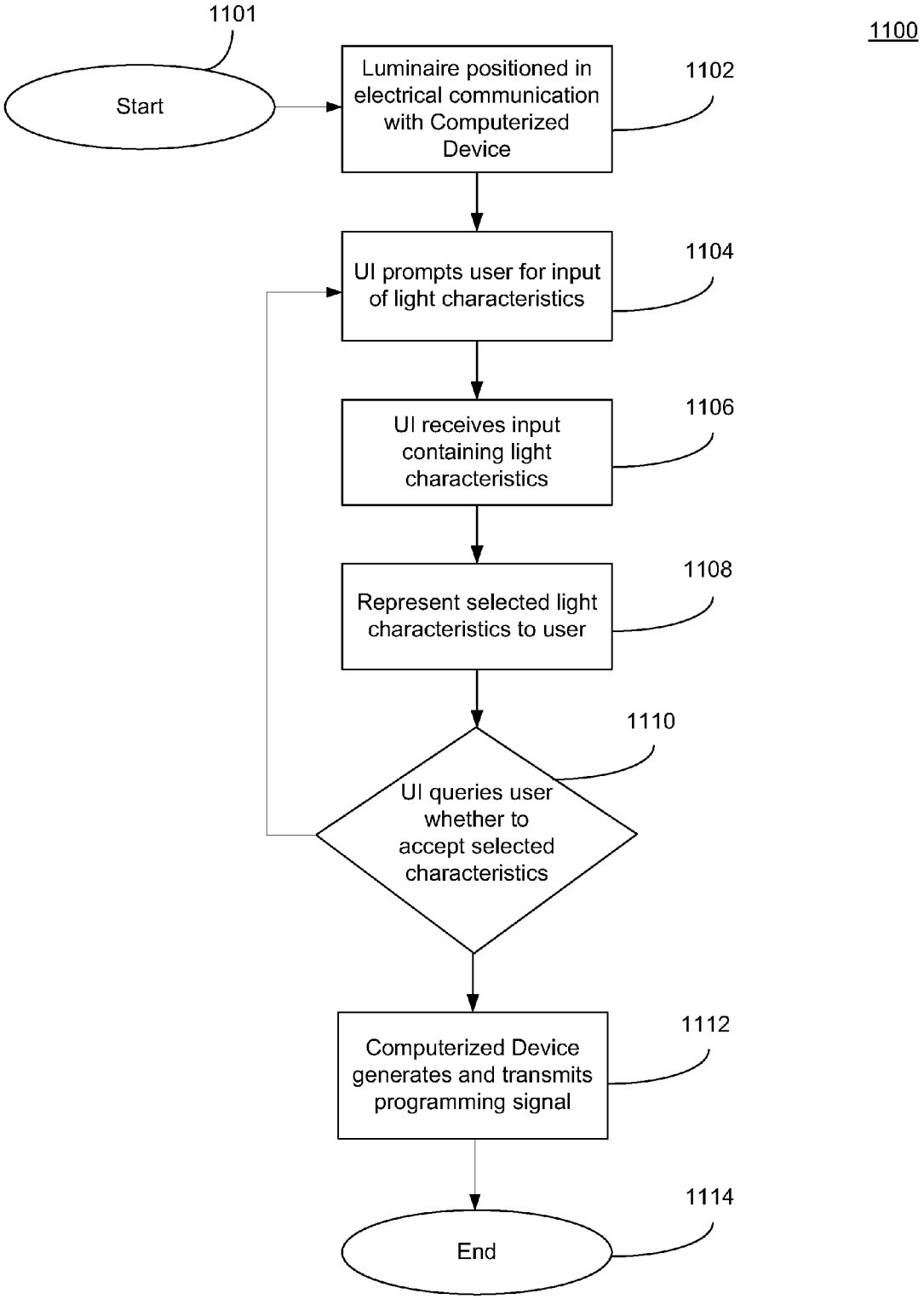

Referring now additionally to flowchart 1100 illustrated in FIG. 10, a method aspect of the present invention is now described in greater detail. In the present method, the computerized device may represent that characteristics of light selected by the user prior to transmitting the programming signal to the luminaire. From the start (Block 1101) the luminaire is positioned into electrical communication with the computerized device at Block 1102. At Block 1104, the user interface prompts a user to input the characteristics of light to be produced by the luminaire. At Block 1106, the user interface receives an input from the user providing one or more characteristics of light for the light source to produce. At Block 1108, the computerized device represents the selected light characteristics to the user. This may be accomplished by a variety of ways, including, but not limited to, recreating a light having the selected characteristics on the display, or transmitting a signal to the luminaire that causes the controller to operate the light source to emit light having the selected characteristics. In such an embodiment, the signal transmitted from the computerized device would not program the controller in a permanent fashion. Instead, the controller would only temporarily be programmed to emit the light indicated by the signal; a permanent programming signal would be required to be transmitted to the controller subsequent to this temporary programming signal.

At Block 1110, the user interface queries the user whether the user wants to accept the selected light characteristics. If the user indicates that s/he accepts the selected characteristics, then at Block 1112 the computerized device may send a programming signal to the luminaire. If, however, the user indicates s/he does not accept the selected characteristics, the method returns to step 1104 and prompts the user to input new light characteristics. The method is ended at Block 1114.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A programmable luminaire system comprising:

a programmable luminaire comprising:

an optic defining an optical chamber;

a light source having a plurality of light-emitting elements;

a controller operably coupled with the plurality of light-emitting elements; and an electrical connector electrically coupled with the controller;

a computerized device configured to electrically communicate with the programmable luminaire; and a docking member configured to electrically couple to each of the luminaire and the computerized device;

wherein the computerized device is configured to transmit an electronic transmission including data to the programmable luminaire via the docking member;

wherein the programmable luminaire is configured to receive the electronic transmission from the computerized device at the electrical connector;

wherein the controller is configured to be programmed responsive to the data of the electronic transmission received by the controller from the computerized device;

wherein each light-emitting element of the plurality of light-emitting elements is operable to emit a source light;

wherein two or more source lights may combine in the optical chamber to define a combined light; and wherein the controller is programmable to selectively operate at least a portion of the plurality of light-emitting elements to produce a combined light having a light characteristic within the range of about 2,000 Kelvin to about 25,000 Kelvin.

2. A programmable luminaire system according to claim 1 wherein the controller is configured to be programmed by a first electronic transmission and prevented from being reprogrammed by any subsequent electronic transmissions.

3. A programmable luminaire system according to claim 1 wherein the controller includes at least one of programmable read-only memory, field programmable read-only memory, or one-time programmable non-volatile memory.

4. A programmable luminaire system according to claim 1 wherein the data of the electronic transmission includes a light characteristic; and wherein the controller is configured to interpret the data and select at least a portion of the plurality of light-emitting elements to operate.

5. A programmable lighting apparatus according to claim 1 wherein the data of the electronic transmission includes instructions for which of the plurality of light-emitting elements the controller is to operate; and wherein the controller is programmable to operate the light-emitting elements indicated by the instructions.

6. A programmable luminaire system according to claim 1 wherein the plurality of light-emitting elements comprises a plurality of light-emitting diodes (LEDs).

7. A programmable luminaire system according to claim 1 wherein the controller is programmable to control the intensity of the source light emitted by each light-emitting element through pulse-width modulation of the operation of each of the light-emitting element.

8. A programmable luminaire system according to claim 7 wherein the electrical connector comprises a light bulb base selected from the group consisting of Edison screw bases, bayonet bases, bi-post bases, bi-pin bases, and wedge bases; and wherein the docking member is a light bulb socket corresponding to the light bulb base comprising the electrical connector.

9. A programmable luminaire system according to claim 8 wherein each of the light bulb bases comprising the electrical connector and the docking member are configurable to facilitate communication of data therethrough.

10. A programmable luminaire system according to claim 1 further comprising a user interface; wherein the user interface is positionable in electronic communication with the computerized device; wherein the user interface is configured to receive an input from a user indicating a selected light characteristic; and wherein the electronic transmission is configurable to be responsive to the selected light characteristic.

11. A programmable luminaire according to claim 10 wherein the portion of the plurality of light-emitting elements may produce combined light having a light characteristic approximately equal to one of a plurality of discrete light characteristics producible by the plurality of light-emitting elements, the discrete light characteristics being within the range of about 2,000 Kelvin to about 25,000 Kelvin; wherein one of the user interface and the computerized device is configurable to determine which of the discrete light characteristics is closest to the selected light characteristic, defining a selected discrete light characteristic; and wherein the electronic transmission is configurable to be responsive the selected discrete light characteristic.

12. A method of programming a lighting apparatus to emit light within a range of light characteristics, the lighting apparatus comprising an optic defining an optical chamber, a light source having a plurality of light-emitting elements, a controller operably coupled with the plurality of light-emitting elements, an electrical connector electrically coupled with the controller, the method comprising the steps of:

positioning the electrical connector in electronic communication with a computerized device;

receiving by the controller an electronic transmission containing data via the electrical connector; and programming the controller responsive to the received electronic transmission;

wherein each light-emitting element of the plurality of light-emitting elements is operable to emit a source light;

wherein two or more source lights may combine in the optical chamber to define a combined light; and wherein the step of programming the controller causes the controller to be programmed to selectively operate a subset of the plurality of light-emitting elements to produce a combined light having a light characteristic within the range of about 2,000 Kelvin to about 25,000 Kelvin.

13. A method according to claim 12 wherein the computerized device comprises a socket member, wherein the step of positioning the electrical connector in electronic communication with the computerized device comprises engaging the electrical connector with the socket member.

14. A method according to claim 12 wherein the data includes a selected light characteristic, and wherein the step of programming the controller responsive to the received electronic transmission comprises the steps of:

determining what combination of source lights emitted from a subset of the plurality of light-emitting elements will yield a combined light having the selected light characteristic; and programming the controller to operate the determined subset of the plurality of light-emitting elements.

15. A method according to claim 12 wherein the data includes identification of a subset of the plurality of light-emitting elements to be operated, and wherein the step of programming the controller responsive to the received electronic transmission comprises programming the controller to operate the identified subset of the plurality of light-emitting elements.

16. A method according to claim 12 wherein the controller includes at least one of programmable read-only memory, field programmable read-only memory, or one-time programmable non-volatile memory.

17. A method according to claim 12 wherein the computerized device comprises a user interface configured to receive input signals from a user indicating a light characteristic, the method further comprising the steps of:

prompting the user on the user interface for a light characteristic; and receiving an input indicating a light characteristic;

wherein the electronic transmission is responsive to the light characteristic indicated by the input.

18. A method according to claim 17 wherein the two or more source lights may combine in the optical chamber to define a combined light having a light characteristic approximately equal to one of a plurality of discrete light characteristics producible by the two or more source lights, the discrete light characteristics being within the range of about 2,000 Kelvin to about 25,000 Kelvin; further comprising the step of:

determining which of the discrete light characteristics is closest to the light characteristic indicated by the input, defining a selected light characteristic;

wherein the electronic transmission is responsive to the selected discrete light characteristic.

19. A method of programming a luminaire to emit light within a range of light characteristics, the luminaire comprising an optic defining an optical chamber, a light source having a plurality of light-emitting elements, a controller operably coupled with the plurality of light-emitting elements, and an electrical connector electrically coupled with the controller, wherein each light-emitting element of the plurality of light-emitting elements is operable to emit a source light, and wherein two or more source lights may combine in the optical chamber to define a combined light having a light characteristic within the range of about 2,000 Kelvin to about 25,000 Kelvin, the method comprising the steps of:

positioning the electrical connector in electronic communication with a computerized device;

receiving a first electronic transmission containing data that includes instructions to operate a first subset of the plurality of light-emitting elements to yield a combined light having a first light characteristic;

receiving a second electronic transmission containing data that includes instructions to operate a second subset of the plurality of light-emitting elements to yield a combined light having a second light characteristic; and programming the controller responsive to one of the first or second electronic transmissions.

20. A method according to claim 19 wherein the step of programming the controller responsive to one of the first or second electronic transmissions comprises programming a firmware of the controller responsive to one of the first or second electronic transmissions.

21. A method according to claim 19 wherein the computerized device comprises a docking member, wherein the step of positioning the electrical connector in electronic communication with the computerized device comprises engaging the electrical connector with the docking member.

22. A method according to claim 19 wherein the computerized device comprises a user interface configured to receive input signals from a user indicating a light characteristic, the method further comprising the steps of:

prompting the user on the user interface for a first light characteristic;

receiving a first input indicating a first light characteristic;

prompting the user on the user interface for a second light characteristic; and receiving a second input indicating a second light characteristic;

wherein the first electronic transmission is responsive to the first light characteristic; and wherein the second electronic transmission is responsive to the second light characteristic.

23. A method according to claim 22 wherein the two or more source lights may combine in the optical chamber to define a combined light having a light characteristic approximately equal to one of a plurality of discrete light characteristics producible by the two or more source lights, the discrete light characteristics being within the range of about 2,000 Kelvin to about 25,000 Kelvin; further comprising the steps of:

determining which of the discrete light characteristics is closest to the first light characteristic, defining a first discrete light characteristic; and determining which of the discrete light characteristics is closest to the second light characteristic, defining a second discrete light characteristic;

wherein the first electronic transmission is responsive to the first discrete light characteristic; and wherein the second electronic transmission is responsive to the second discrete light characteristic.

* * * * *